US006368550B1

(12) United States Patent
Wagener et al.

(10) Patent No.: US 6,368,550 B1
(45) Date of Patent: Apr. 9, 2002

(54) VARIABLY INSERTABLE COMBINED LANCE WITH DISPLACEABLE BURNER AND BLOWER LANCE BODIES

(75) Inventors: Friedhelm Wagener, Duisburg; Arno Luven, Krefeld, both of (DE)

(73) Assignee: Technometal Gesellschaft für Metalltechnologie mbH (DE)

( * ) Notice: Subject to any disclaimer, the term of this patent is extended or adjusted under 35 U.S.C. 154(b) by 0 days.

(21) Appl. No.: 09/673,925

(22) PCT Filed: Apr. 19, 1999

(86) PCT No.: PCT/DE99/01202

§ 371 Date: Dec. 22, 2000

§ 102(e) Date: Dec. 22, 2000

(87) PCT Pub. No.: WO99/54511

PCT Pub. Date: Oct. 28, 1999

(30) Foreign Application Priority Data

Apr. 20, 1998 (DE) ..... 198 17 590

(51) Int. Cl.[7] ..... C21C 5/32
(52) U.S. Cl. ..... 266/225; 266/268
(58) Field of Search ..... 266/225, 217, 266/265, 268

(56) References Cited

U.S. PATENT DOCUMENTS 3,972,517 A * 8/1976 Kraizinger et al. ..... 266/225
5,788,921 A * 8/1998 Gitman et al. ..... 266/225

* cited by examiner

*Primary Examiner*—Scott Kastler
(74) *Attorney, Agent, or Firm*—R. W. Becker & Associates; R. W. Becker

(57) ABSTRACT

A lance is provided for processing molten metal baths located in metallurgical tanks, and for heating the tanks. A first lance body is displaceable in a second lance body. A mechanism is provided for displacing the first lance body relative to the second lance body such that in a raised burner position of the first lance body, burner nozzles disposed in the second lance body are uncovered by the first lance body and are axially spaced from the lance mouth of the first lance body to receive gas discharge from the lance mouth and to allow burner operation. In a lowered blower position of the first lance body, the burner nozzles are covered thereby. The mechanism for displacing the lance bodies relative to one another permits infinitely variable spacing of the burner nozzles from the lance mouth that is provided for the discharge of gas.

4 Claims, 2 Drawing Sheets

VARIABLY INSERTABLE COMBINED LANCE WITH DISPLACEABLE BURNER AND BLOWER LANCE BODIES

This application is a 371 of PCT/DE99/01202, filed on Apr. 19, 1999.

BACKGROUND OF THE INVENTION

The invention relates to a lance for processing molten metal baths located in metallurgical tanks, particularly steel subjected to a vacuum in RH tanks and furthermore for heating the RH tanks prior to or between processing phases, and having an internal guide pipe for conducting gases, in particular oxygen, with a lance mouth located at its head end for blowing the gas and with a first cooling jacket over its entire length and that is connected at its foot end to gas and cooling media supplies, whereby for executing a burner function the lance has channels arranged on the exterior circumference of the first cooling jacket for the purpose of feeding a fuel gas to burner nozzles formed in the region of the head-end lance mouth and oriented at an oblique angle to the longitudinal axis and the fuel gas channels are enclosed by a second external cooling jacket.

DE 44 42 362 C1 describes a lance for processing molten metal baths that has the aforesaid features. The multifunction lance known herefrom permits blowing oxygen with and without solids and permits a burner flame to be generated for heating the tank, steps that are independent of each other. When oxygen is blown, the oxygen is blown via the internal guide pipe provided with a Laval-type lance mouth, while when in the burner mode the fuel gas channels admit fuel gas so that in the region of the lance mouth the desired flame is formed when a combustion reaction takes place as the oxygen discharges in the burner mode.

The known multifunction lance is associated with the disadvantage that during the oxygen blowing process and during the subsequent deep-vacuum processing, due to the somewhat strong reaction of the molten metal bath to be processed, slag and/or metal can spatter so that the burner nozzles at the end of the multifunction lance are affected and are thus no longer available for subsequent burner operations. Known in order to avoid this is keeping the burner nozzles clear by means of an inert gas inserted into the fuel gas channels during the entire process; this is correspondingly expensive.

The object of the invention is therefore to provide a lance with the features cited in the foregoing in which there is both an oxygen blowing mode and a burner mode, said modes being independent of each other, and in which the burner nozzles are protected against becoming plugged up by spattered material without the burner nozzles having to be supplied with inert gas.

SUMMARY OF THE INVENTION

This object is achieved, including advantageous embodiments and further developments of the invention, from the contents of the patent claims that follow this specification.

The basic idea behind the invention provides that the internal guide pipe with the first cooling jacket is embodied as a first lance body and the fuel gas channels with the second cooling jacket are embodied as a second lance body and the first lance body is displaceably arranged in the second lance body and can be shifted between a raised position in which it operates as a burner and a lowered position in which it operates as a blower and in which the burner nozzles are covered by the first lance body, which projects downward in relation to the end of the second lance body.

The invention is associated with the advantage that the lance can be shifted from the oxygen-blowing function to the burner function by simply displacing the first lance body in the second lance body, whereby in the oxygen-blowing mode the first lance body overlays the second lance body that has the burner nozzles such that the first lance body completely covers the burner nozzles, which are oriented at an oblique angle to its longitudinal axis, and mechanically protects the burner nozzles from spattered material. This provides the burner nozzles with protection that is effective and easy to use. An additional advantage is that the existing lance, which previously was configured solely as an oxygen blower, is reconfigured by means of a second lance body placed thereover and thus can be provided as a combined lance for operating as both blower and burner.

In accordance with one exemplary embodiment of the invention it is provided that the second lance body annularly encloses the first lance body so that the lance can be operated concentric to the RH tank axis in both burner and blower modes.

Furthermore provided in accordance with one exemplary embodiment of the invention is that the first lance body can be displaced in the second lance body for infinitely variable spacing of the burner nozzles from the burner mouth of the second lance body. This is associated with the particular advantage that it is possible to obtain optimum combustion of the fuel gas introduced due to the variably adjustable spacing of the burner nozzles relative to the lance mouth for the oxygen outlet. In burner mode as a rule only about ⅕ to 1/10 of the quantity of oxygen has to be fed through the internal guide pipe of the lance compared to the quantity of oxygen used during blowing operations, so the Laval nozzle formed in the region of the lance mouth does not work and the discharge conditions for the oxygen are completely different here compared to the conditions in the oxygen-blowing mode. This can be accomplished by optimally adjusting the spacing of the burner nozzles relative to the lance mouth while paying attention to the stoichiometric relationship of oxygen to fuel gas. Since a substantial amount of water is associated with the reaction of the fuel gas with the oxygen, optimizing the spacing of the burner nozzles from the site at which the oxygen discharges can reduce the amount of water that necessarily occurs during the heating process.

With regard to the lift attachment of the first lance body and its displaceability in the second lance body, it can be provided that the first lance body can be moved by a lift apparatus that is attached to the second lance body. In this embodiment the second lance body can be embodied correspondingly shorter.

Alternatively, it can be provided that the second lance body extends over the entire length of the first lance body and that separately arranged lift apparatus are provided for the first lance body and for the second lance body. In this case both lance bodies are guided through the packing gland arranged in the cover of the processing tank so that the appropriate lift apparatus then assume the spacing function for the two lance bodies when in the burner mode.

BRIEF DESCRIPTION OF THE DRAWINGS

The drawing illustrates one exemplary embodiment of the invention that is described in the following, and in which.

DESCRIPTION OF PREFERRED EMBODIMENTS

Figure 1:
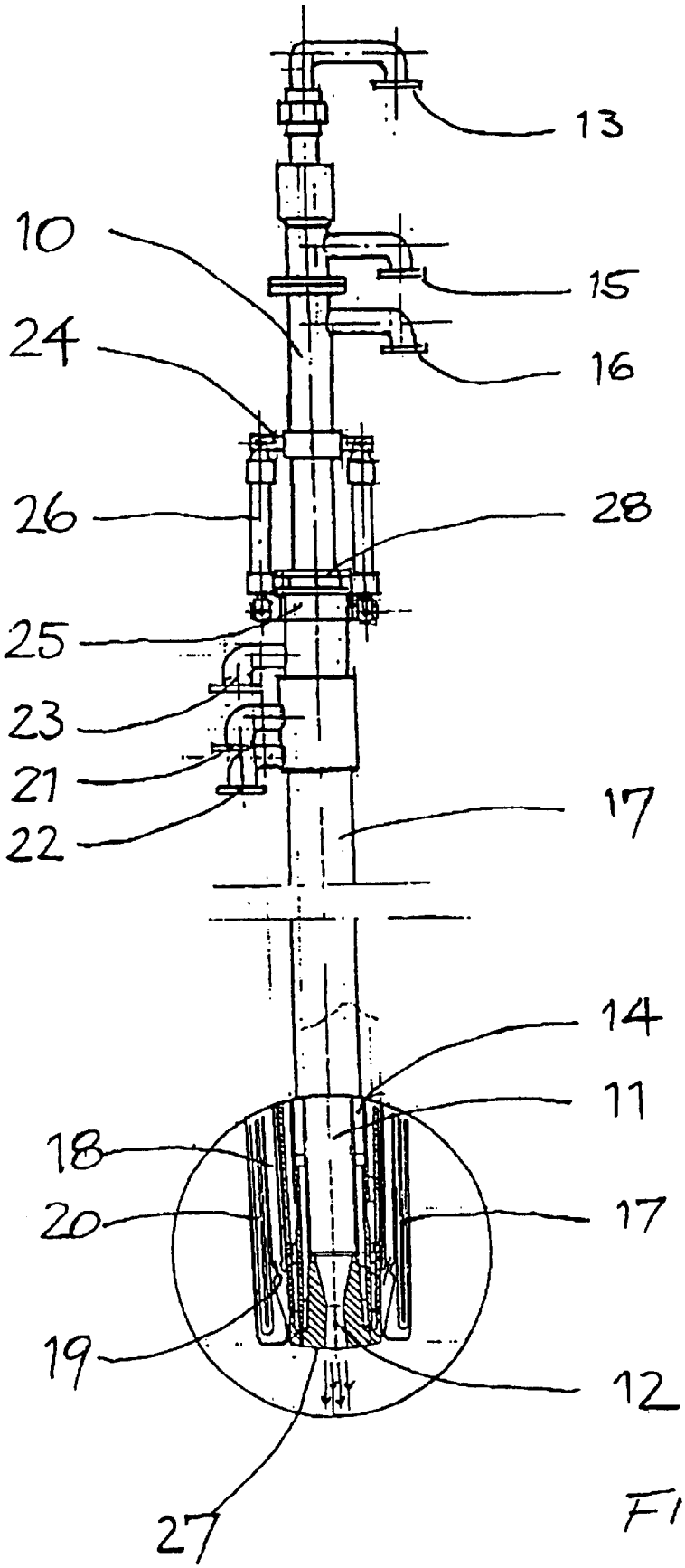
FIG. 1 is a side elevation of a variable combined lance, with an enlarged sectional view of the foot region in oxygen-blowing mode.

As can be seen in the figures, the combined lance has a first lance body 10 that extends over the entire length of the lance and has an internal guide pipe 11 for conducting in particular oxygen for processing molten metal baths. Located at the free end of the first lance body 10 is a Laval nozzle 12 through which the oxygen is blown onto the surface of the bath. At its upper end the first lance body 10 has an oxygen connection 13.

For cooling the first lance body 10, the internal guide pipe 11 is enclosed by a first cooling jacket 14 to which a cold water inlet 15 and a cold water outlet 16 are allocated in the upper region of the first lance body 10.

The first lance body 10 is displaceably arranged in the second lance body 17, whereby the second lance body 17 and its cooling jacket 20 annularly enclose the first lance body. Embodied in the second lance body 17 are fuel gas channels 18 that open at its lower end in burner nozzles 19 that are arranged at an oblique angle to the longitudinal axis of the lance. The second lance body 17 has an external second cooling jacket 20 to which is allocated a water inlet 21 and a water outlet 22. The fuel gas channels 18 are connected to a fuel gas supply 23.

Both lance bodies 10, 17 are mutually guided through a packing gland (not shown in detail in the drawing) in the cover of the RH processing tank, whereby at the beginning or at the end of an oxygen-blowing operation or burner operation this lance unit is driven by means of a lift apparatus (not shown in the drawing) across a vertical path of travel that is about 4 m to 5 m long into the upper park position or into the lower operating position. The second lance body 17 is connected to the external pipe of the cooling jacket 20 and to a lance slide (not illustrated in the drawing) of the lift apparatus by means of a clamp connection.

Since the two lance bodies 10, 17 are mutually displaceable and since this creates an annular gap between the external jacket of the first lance body 10 and the internal jacket of the second lance body 17, arranged at the upper end of the lance body 17 is a vacuum-tight packing gland 28 that encloses the lance body 10.

For keeping the first lance body 10 on the second lance body 17, arranged on the second lance body is a flange 25 with which two hydraulic cylinders 26 engage that bear the first lance body 10, which is connected via an associated flange 24, so that the first lance body 10 is displaceably arranged in the second lance body 17 via the drive from the cylinders 26. In the position illustrated in FIG. 1, the first lance body 10 is in the "lowered" position in which the end of the first lance body 10 is flush with the end of the second lance body 17 so that the lance mouth 27 for blowing the oxygen is created by the internal guide pipe 11 and the associated Laval nozzle 12. In this position the burner nozzles 19 are completely covered by the first lance body 10 so that any material that spatters is not able to reach the burner nozzles 19.

Figure 2:
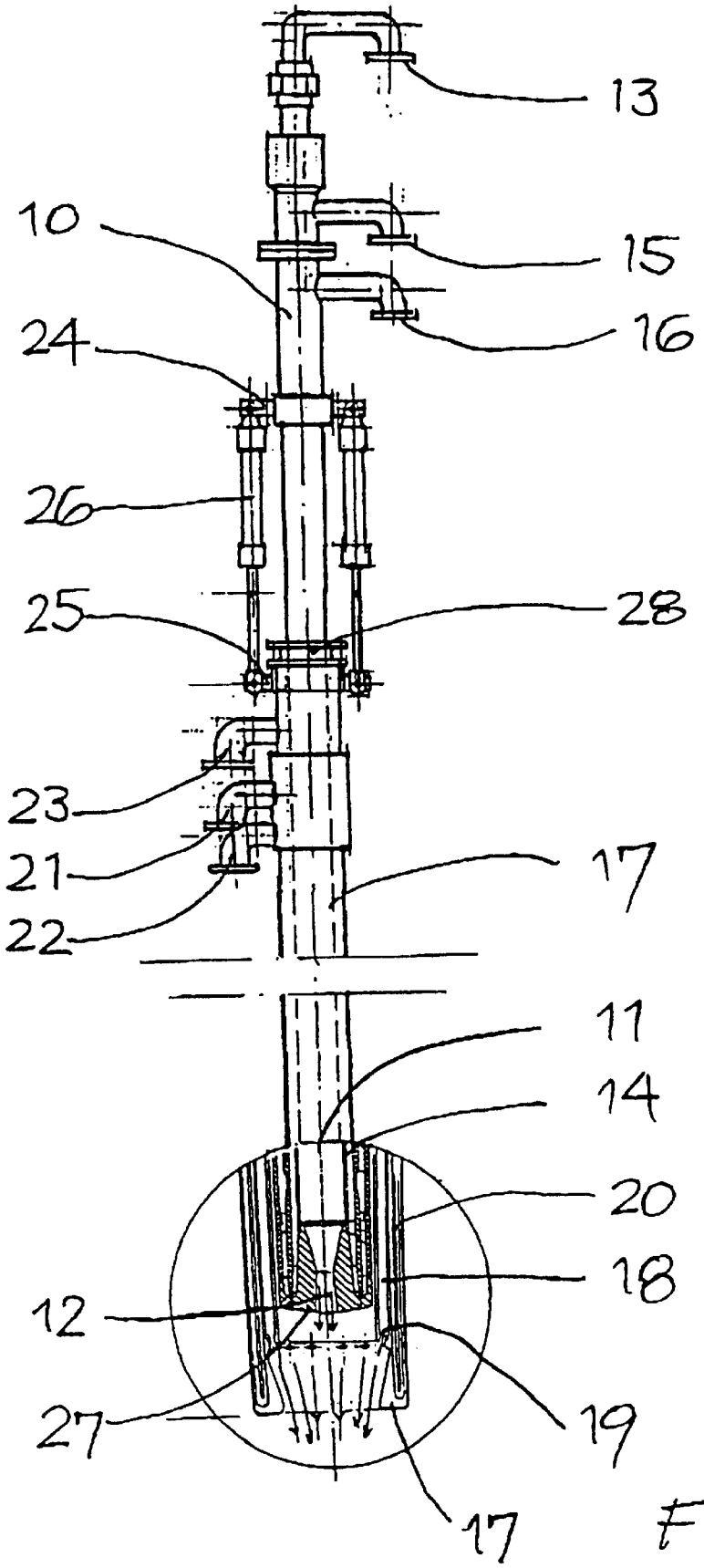
FIG. 2 illustrates the variable combined lance in accordance with FIG. 1 in the burner mode position.

As can be seen from FIG. 2, the burner nozzles 19 are uncovered when the first lance body 10 is raised in the second lance body 17 so that as oxygen continues to discharge there is a reaction between the fuel gas and the oxygen in the region of the lance mouth 27 and thus the desired burner flame is created. The cylinders 26 can be used for infinitely-variable adjustment of the distance of the burner nozzles 19 to the oxygen outlet from the lance mouth 27 so that it is possible to manage the combustion reaction in an optimum manner.

The features of the subject of this document as disclosed in the foregoing specification, in the patent claims, in the abstract, and in the drawing can be essential individually or in any combination for achieving the invention in its various embodiments.

The specification incorporates by reference the disclosure of German priority documents DE 198 17 590.6 of Apr. 20, 1998 and German Patent Application priority document PCT/DE99/01202 of Apr. 19, 1999.

The present invention is, of course, in no way restricted to the specific disclosure of the specification and drawings, but also encompasses any modifications within the scope of the appended claims.

What is claimed is:

1. A lance for processing molten metal baths located in metallurgical tanks, and for heating the tanks, comprising:

an internal guide pipe, in the form of a first lance body, for conducting gas from a gas supply to a lance mouth for the discharge of said gas;

a first cooling jacket provided over the entire length of said first lance body and connected to a cooling medium supply;

a second lance body which is provided with fuel gas channels disposed adjacent to said first cooling jacket of said first lance body, wherein said first lance body is displaceable in said second lance body;

a second cooling jacket for enclosing said fuel gas channels;

burner nozzles disposed in said second lance body in the vicinity of said lance mouth of said first lance body and at an oblique angle to a longitudinal axis of said lance, wherein fuel gas is supplied to said burner nozzle via said fuel gas channels; and means for displacing said first lance body relative to said second lance body such that in a raised burner position of said first lance body, said burner nozzles are uncovered by said first lance body and are axially spaced from said lance mouth from said first lance body to receive gas discharge from said lance mouth and to allow burner operation, and in a lowered blower position of said lance body, said burner nozzles are covered by said first lance body, and wherein said means for displacing said first lance body relative to said second lance body permits infinitely variable spacing of said burner nozzles from said lance mouth that is provided for the discharge of gas.

2. A lance according to claim 1, wherein said second lance body annularly encloses said first lance body.

3. A lance according to claim 1, wherein said means for displacing said first lance body relative to said second lance body is a lift mechanism that is attached to said second lance body.

4. A lance according to claim 1, wherein said second lance body extends over the entire length of said first lance body, and wherein said means for displacing said first lance body relative to said second lance body are separately disposed lifting mechanisms for said first lance body and for said second lance body.

* * * * *